US005940088A

United States Patent [19]

Hsu

[11] Patent Number: 5,940,088

[45] **Date of Patent: *Aug. 17, 1999**

[54] METHOD AND STRUCTURE FOR DATA TRAFFIC REDUCTION FOR DISPLAY REFRESH

[75] Inventor: Fu-Chieh Hsu, Saratoga, Calif.

[73] Assignee: Monolithic System Technology, Inc., Sunnyvale, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/501,332

[22] Filed: Jul. 12, 1995

[51] Int. Cl.[6] ..... G09G 5/00

[52] U.S. Cl. ..... 345/514; 345/511; 345/203; 345/512

[58] Field of Search ..... 395/383; 345/520, 345/521, 525, 524, 507, 509, 515, 196, 513, 516, 514, 202, 511, 512, 203

[56] References Cited

U.S. PATENT DOCUMENTS 5,473,764 12/1995 Chi ..... 395/383
5,526,025 6/1996 Selwan et al. ..... 345/200

*Primary Examiner*—Richard A. Hjerpe
*Assistant Examiner*—Kent Chang
*Attorney, Agent, or Firm*—Skjerven, Morrill, MacPherson, Franklin & Friel LLP; Norman R. Klivans

[57] ABSTRACT

A method and structure for performing a screen refresh operation in a video processing system which includes a frame buffer memory and a display controller coupled to a system bus. A status bit memory is used to store status bits which represent the repetitive characteristics of pixel data stored in the frame buffer memory. The status bits are provided to the display controller. In response, the display controller determines whether to provide pixel data by regenerating pixel data previously retrieved from the frame buffer memory or by accessing the frame buffer memory.

17 Claims, 6 Drawing Sheets

Key To

METHOD AND STRUCTURE FOR DATA TRAFFIC REDUCTION FOR DISPLAY REFRESH

BACKGROUND OF THE INVENTION

1. Field of Invention

The present invention relates to a graphics display system that reads pixel data periodically from a frame buffer memory for screen display. More specifically, the invention relates to a method and structure for reducing the amount of pixel data transmitted from the frame buffer memory during refresh operations.

2. Description of Related Art

FIG. 1 is a block diagram of a typical graphics system 100 of a personal computer. System 100 is a multi-processor system which includes display controller 101, graphics processor 102, system processor 103, video processor 104, memory interface 105, frame buffer memory 106, system bus 107, CRT display 108 and system processor interface 109. Processors 101–104 are each coupled to system bus 107, with system processor 103 being coupled to bus 107 through system processor interface circuit 109. Frame buffer memory 106 is coupled to system bus 107 through memory interface 105. Frame buffer memory 106 is typically constructed using dynamic random access memory (DRAM) and has the capacity to store pixel data for at least one frame of a video display image. Processors 101–104 each access frame buffer memory 106 via bus 107. Processors 101, 102 and 104, system processor interface 109, and memory interface 105 are usually integrated into a single chip.

In general, the performance of system 100 is limited by the bandwidth of frame buffer memory 106. More specifically, display controller 101 consumes most of the data bandwidth of frame buffer memory 106 when CRT display 108 is in higher resolution modes with more bits per pixel (for more color variations). For example, if CRT display 108 is to display an image having 1,024×768 pixels at 24 bits (three 8-bit bytes) per pixel, frame buffer memory 106 must have a capacity of 2.36 MBytes to store the entire image. To minimize flicker of the image on display 108, a relatively high screen refresh rate, such as 75 Hz to 100 Hz, should be used. In such a system, the average data bandwidth requirement is approximately 177 to 236 MBytes per second (i.e., 2.36 MBytes are read from frame buffer memory 106 and displayed 75 to 100 times each second). Subtracting horizontal and vertical retrace time, the actual peak data bandwidth requirement of frame buffer memory 106 is approximately 250 to 390 MBytes per second. At higher resolutions, such as 1,280×1,024 pixels at 24 bits per pixel, the actual data bandwidth requirement of frame buffer memory 106 is 400 to 600 MBytes per second. The above-listed actual data bandwidth requirements only include the bandwidth required for refreshing the CRT display 108.

Pixels used to form graphics and video images generally have many repetitions in both time and space. That is, pixels in close physical proximity with one another often have the same value, and consecutive pixels will often have the same value over a relatively long interval of time (as compared to the screen refresh rate). Compression algorithms such as JPEG and MPEG have been developed to take advantage of these temporal and spatial redundancies. Such compression algorithms can provide compression ratios from 5:1 to 100:1, thereby reducing the amount of data required to represent the image. These algorithms, however, are very complex and require significant processing power to encode and decode. Therefore, encoding (compression) is usually done once with the resultant data primarily for storage and distribution, and decoding (de-compression) is done only once for the playback operation.

Modification or manipulation of pixel data in real time is difficult unless the pixel data is present in a de-compressed format in frame buffer memory 106. Moreover, in computer graphics display system 100, many applications may need to access or modify the contents of frame buffer memory 106. For these reasons, the pixel data is generally maintained in a de-compressed format in frame buffer memory 106. Because pixel data is accessed in a de-compressed format when refreshing CRT display 108, general compression/de-compression algorithms are not suitable for reducing the data bandwidth requirement of frame buffer memory 108 during the refreshing of CRT display 108.

It would therefore be desirable to have a structure and method to reduce the data bandwidth requirement of a frame buffer memory during a display refresh operation. It would also be desirable for such a structure and method to have minimum circuit and data access overhead. Such a structure and method would advantageously free up frame buffer memory bandwidth to enable other system processors and processes to achieve higher performance.

SUMMARY OF THE INVENTION

Accordingly, the present invention provides a method and structure for performing a screen refresh operation in a video processing system. A video processing system in accordance with one embodiment of the invention includes a frame buffer memory and a display controller, each coupled to a system bus. The frame buffer memory has the capacity to store one frame of uncompressed pixel data. The display controller accesses pixel data from the frame buffer memory over the bus and provides pixel data for display.

A status bit memory is coupled to the display controller. The status bit memory stores a plurality of status bits representative of the repetitive characteristics of the pixel data in the frame buffer. The status bits are used to determine whether the display controller can provide pixel data by regenerating pixel data which has already been retrieved from the frame buffer memory, or whether display controller must access frame buffer memory to provide pixel data.

In a particular embodiment, the frame buffer memory is divided into a plurality of consecutive segments. Each segment is further divided into a plurality of sub-units, called herein "buckets", with each bucket representing an integer number of pixel values. Each status bit corresponds to one of the segments and indicates whether the last bucket of the corresponding segment is identical to each of the buckets of a consecutive segment. The display controller can include a bucket comparator which compares the last bucket of each segment with each of the buckets of a consecutive segment.

The display controller can also include a status bit checker which monitors the status bits corresponding to respective segments. If a status bit is set (indicating that the last bucket of the corresponding segment is identical to each of the buckets in a consecutive segment), means for regenerating the last bucket of the corresponding segment are enabled to provide the next consecutive segment. As a result, the display controller is not required to access the frame buffer memory to provide the next consecutive segment. This can greatly reduce the bandwidth consumed on the system bus during a refresh operation, especially when there are many repeated pixel values in the frame of pixel data.

The system can also include a memory interface coupled between the system bus and the frame buffer memory. Such a memory interface has a memory write checker which monitors write accesses to the frame buffer memory, determines the segments to which the write accesses are directed and resets the status bits corresponding to the segments to which the write accesses are directed.

A method in accordance with the present invention includes the steps of (1) partitioning the pixel data in the frame buffer memory into a plurality of consecutive segments, (2) partitioning each of the segments into a plurality of buckets, with each bucket representing an integer number of pixels, (3) retrieving a first segment from the frame buffer memory, (4) storing a bucket of the first segment in a bucket memory external to the frame buffer memory, (5) retrieving a second segment which is consecutive with the first segment from the frame buffer memory, (6) comparing the bucket of the first segment stored in the bucket memory with each bucket of the second segment, and (7) setting a status bit corresponding to the first segment if the bucket of the first segment stored in the bucket memory is identical to each bucket of the second segment. This method enables the status bits to represent the repetitive nature of the pixel values of the frame.

The above described method can also include the steps of (8) determining whether the status bit corresponding to the first segment is set, and (9) regenerating a bucket stored in the bucket memory to create the second segment, whereby the second segment is not required to be retrieved from the frame buffer memory. Again, this reduces the bandwidth consumed by the refresh operation.

The above described method can also include the step of resetting the status bit corresponding to the first segment when a write operation is performed to the first segment in the frame buffer memory.

The present invention will be more fully understood in light of the following detailed description taken together with the drawings.

DETAILED DESCRIPTION

Figure 1:
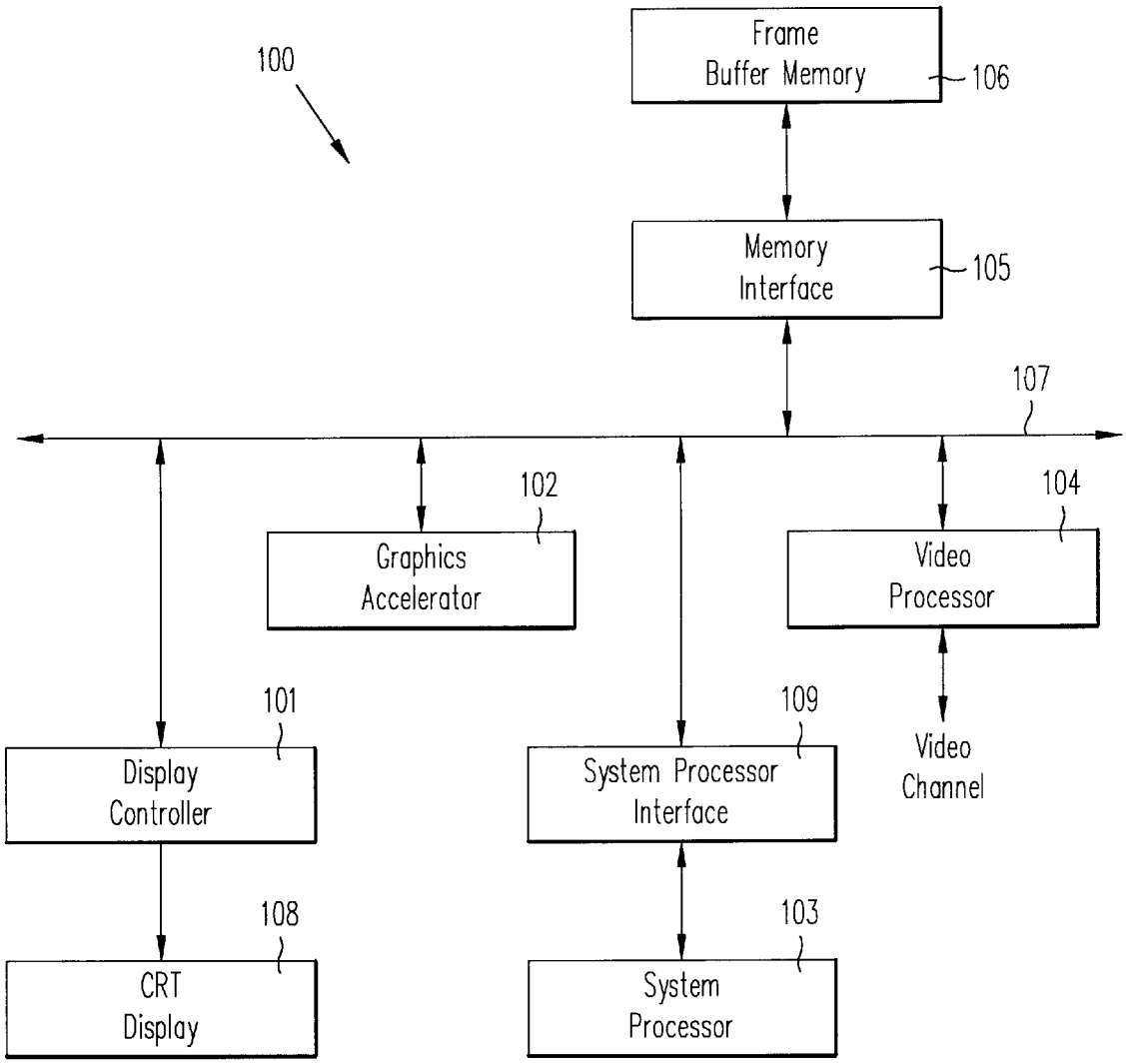
FIG. 1 (Prior Art)
FIG. 1 is a block diagram of a conventional video display processing system.
Figure 2:
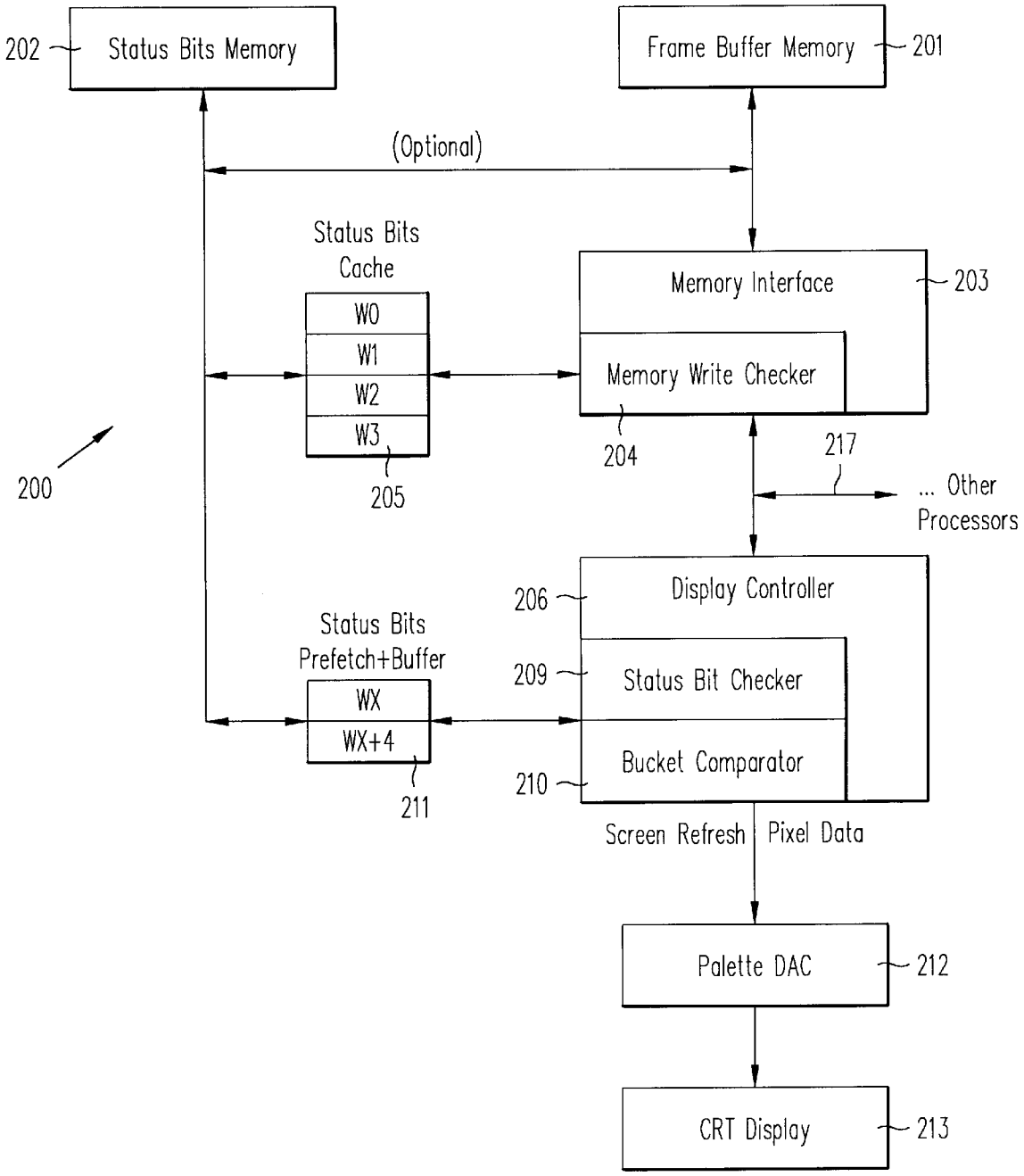
FIG. 2 is a block diagram of a memory and display system in accordance with one embodiment of the invention.

FIG. 2 is a block diagram of a memory and display system 200 in accordance with one embodiment of the invention. System 200 includes frame buffer memory 201, status bit memory 202, memory interface 203, memory write checker 204, status bits cache 205, display controller 206, status bit checker 209, bucket comparator 210, status bit prefetch buffer 211, digital to analog converter (DAC) 212, cathode-ray tube (CRT) display 213 and system bus 217. DAC 212 can be a conventional pallete DAC or a conventional video DAC. Additional processors (not shown), such as processors 102–104 (FIG. 1) can be connected to system bus 217.

Frame buffer memory 201 stores uncompressed pixel values representative of at least one frame of video display information. In the described embodiment, CRT display 213 has a resolution of 1,024×768 pixels and each pixel has a depth of 16 bits per pixel. Each pixel is represented by two 8-bit bytes. In such an embodiment, frame buffer memory 201 has a capacity of 1.6 MBytes. Other embodiments can use other resolutions and pixel depths.

Figure 3A:
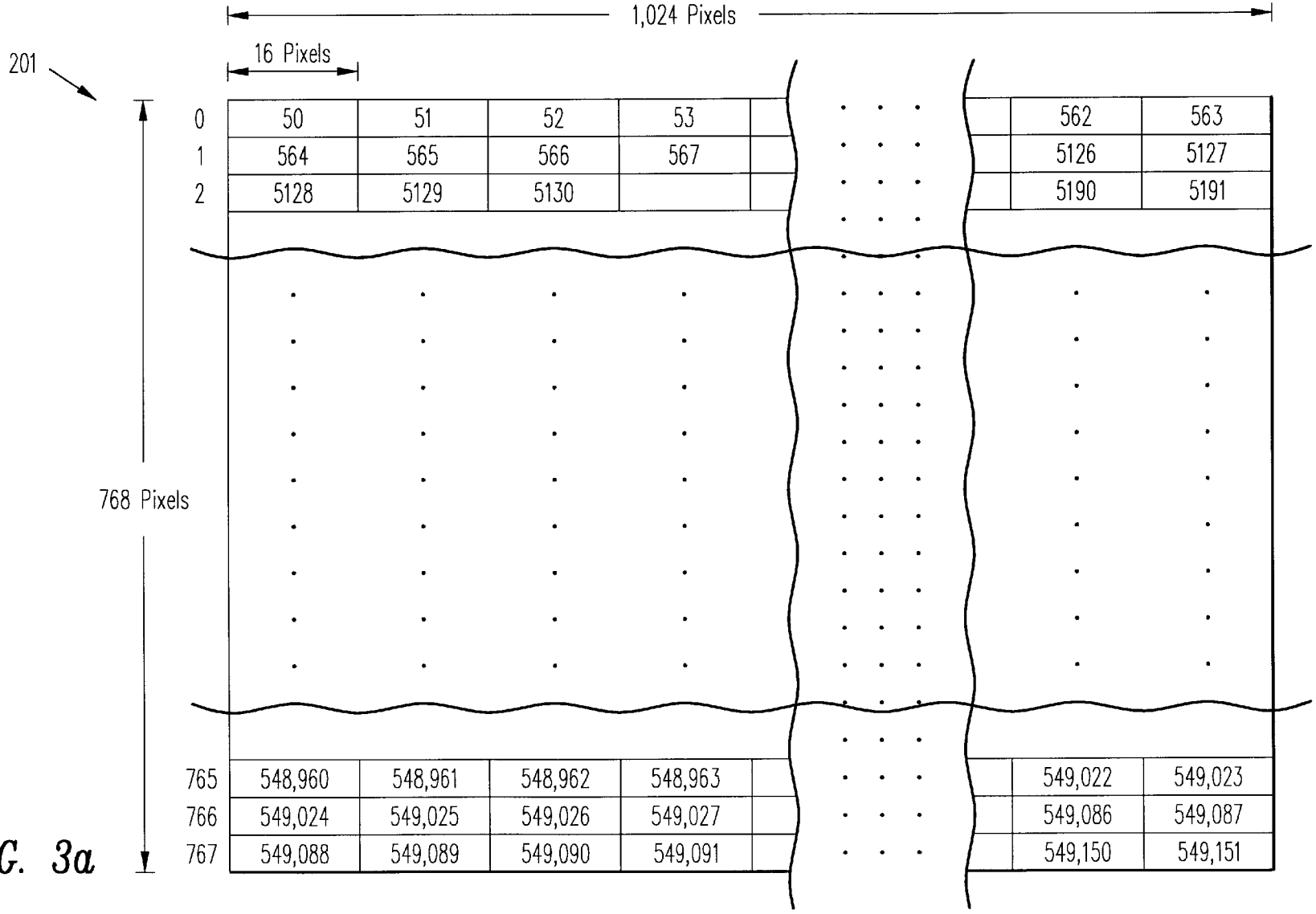
FIG. 3*a* is a block diagram illustrating a frame buffer memory divided into a plurality of segments in accordance with one embodiment of the invention.

As illustrated in FIG. 3*a*, frame buffer memory 201 is divided into a plurality of 32-byte segments $S_0$–$S_{49,151}$. Thirty-two byte segments are suitable for systems which utilize pixel depths of 4 bits, 8 bits, 16 bits or 32 bits. In the example described herein, each 32-byte segment represents 16 pixels. Thus, each row of 1,024×768 pixel CRT display 213 is represented by 64 segments (e.g., $S_0$–$S_{63}$), and the entire 1,024×768 pixel CRT display 213 can be represented by 49,152 segments (e.g., $S_0$–$S_{49,151}$).

Figure 3B:
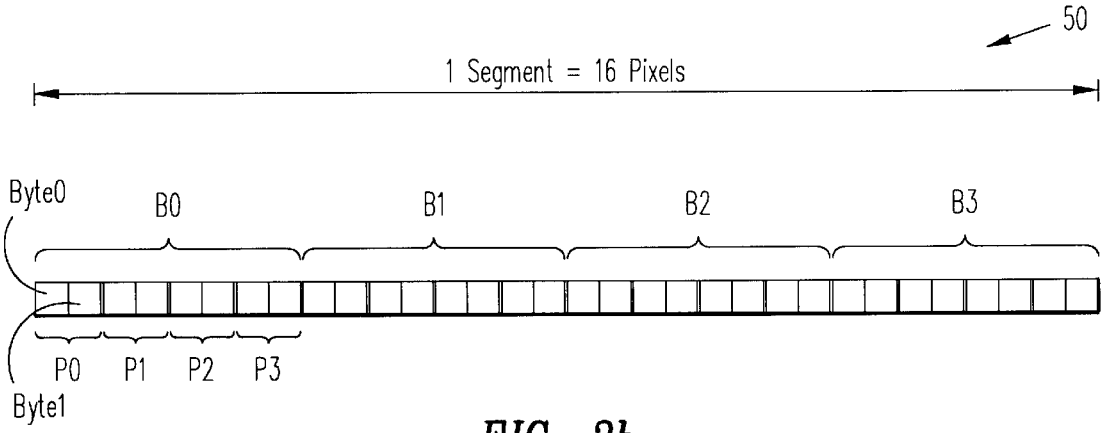
FIG. 3*b* is a block diagram illustrating a segment in accordance with one embodiment of the invention.

FIG. 3*b* illustrates segment $S_0$, which has the same format as segments $S_1$–$S_{49,151}$. Thirty-two byte segment $S_0$ is further divided into four 8-byte sub-units which are hereinafter referred to as "buckets" B0–B3. Each of buckets B0–B3 represents four pixels. For example, bucket B0 includes pixels P0–P3. Each pixel is represented by two 8-bit bytes. For example, pixel P0 is represented by bytes BYTE0 and BYTE1.

In other embodiments, other segment and bucket sizes can be used. Each segment preferably represents an integer number of pixels and includes an integer number of buckets. Each bucket preferably represents an integer number of pixels. For example, in a system utilizing a pixel depth of 24 bits, a 24-byte segment can be used. In such an embodiment, each segment can include four buckets, with each bucket including six 8-bit bytes.

Each of segments $S_0$–$S_{49,151}$ has a corresponding status bit stored at a memory location in status bit memory 202 (FIG. 2). Status bit memory 202 can be a memory located in an off-screen portion of frame buffer memory 201. Alternatively, status bit memory 202 can be a memory separate from frame buffer memory 201. The required capacity of status bit memory 202 is 48 Kbits, which is 0.4 percent of the capacity of frame buffer memory 202.

Figure 4:
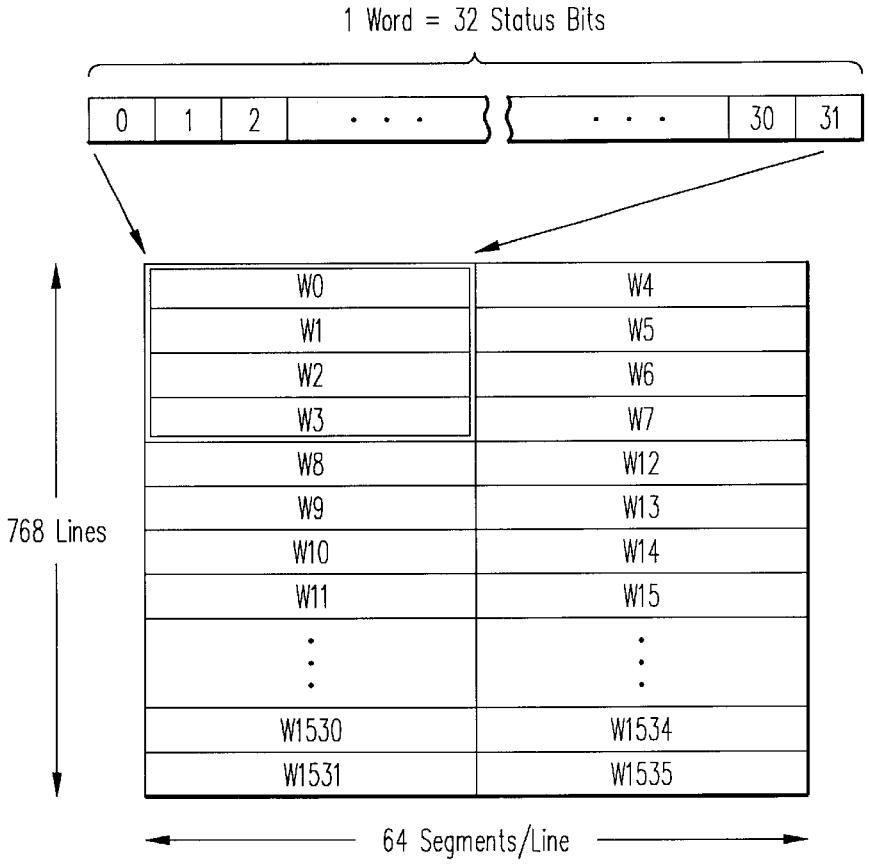
FIG. 4 is a block diagram illustrating the mapping of status bits in accordance with one embodiment of the invention.

FIG. 4 is a diagram illustrating the organization of the status bits corresponding to segments $S_0$–$S_{49,151}$ in accordance with one embodiment of the invention. These status bits are organized into 32-bit status words $W_0$–$W_{1,535}$. Each of status words $W_0$–$W_{1,535}$ includes the status bits for thirty-two segments. For example, status word $W_0$ includes the status bits for segments $S_0$–$S_3$, and status word $W_4$ includes the status bits for segments $S_{32}$–$S_{63}$. Thus, each row of status bit memory 202 stores the status bits corresponding to a row of segments. As illustrated in FIG. 4, each row of status bit memory 202 is mapped to include status words $W_M$ and $W_{M+4}$. Status bit memory 202 is further mapped such that status words $W_M$, $W_{M+1}$, $W_{M+2}$ and $W_{M+3}$ are located in a vertically consecutive manner. As described in more detail below, the status bits stored in status bit memory 202 are used to reduce the bandwidth consumed on bus 217 during the refreshing of display 213.

A typical frame of video display information may be considered to consist of a background image and one or more object images. Each object image may further consist of a background image and smaller object images. The background image is typically solid, uniformly textured or uniformly patterned. As a result, horizontally consecutive pixels of a background image are often identical or exhibit a fixed pattern. Certain video applications create textured or patterned backgrounds by repeating groups of four pixels. Because a relatively large percentage of the image is typically a background image, a relatively large percentage of horizontally consecutive pixels displayed are also identical or exhibit a fixed pattern. In the present invention, horizontally consecutive pixels which are identical or exhibit a fixed pattern are identified and generated without accessing frame buffer memory 201, thereby reducing the data bandwidth consumed by a refresh operation.

More specifically, the last bucket of each of segments $S_0$–$S_{49,151}$ is compared with each of the buckets of a corresponding subsequent segment. For example, the last bucket B3 of segment $S_0$ is compared to each of buckets B0–B3 of segment $S_1$. Four bucket comparisons are therefore performed, with each bucket comparison comparing four pixels of segment $S_0$ with four pixels of segment $S_1$. As a result, the present invention is effective in identifying both repetitive pixels and repetitive pixel patterns. As described in more detail below, bucket comparisons are performed by bucket comparator 210. If the last bucket B3 of segment $S_0$ is identical to each of the four buckets B0–B3 of segment $S_1$, a status bit corresponding to segment $S_0$ is set. The next time that segment $S_0$ is accessed, the status bit corresponding to segment S0 is checked by status bit checker 209. If this status bit is set, the last bucket of segment $S_0$ is regenerated four times, thereby effectively generating segment $S_1$. Consequently, segment $S_1$ can be generated without having to access frame buffer memory 201. As a result, the bandwidth consumed on system bus 217 during a display refresh operation is greatly reduced.

Figure 5A:
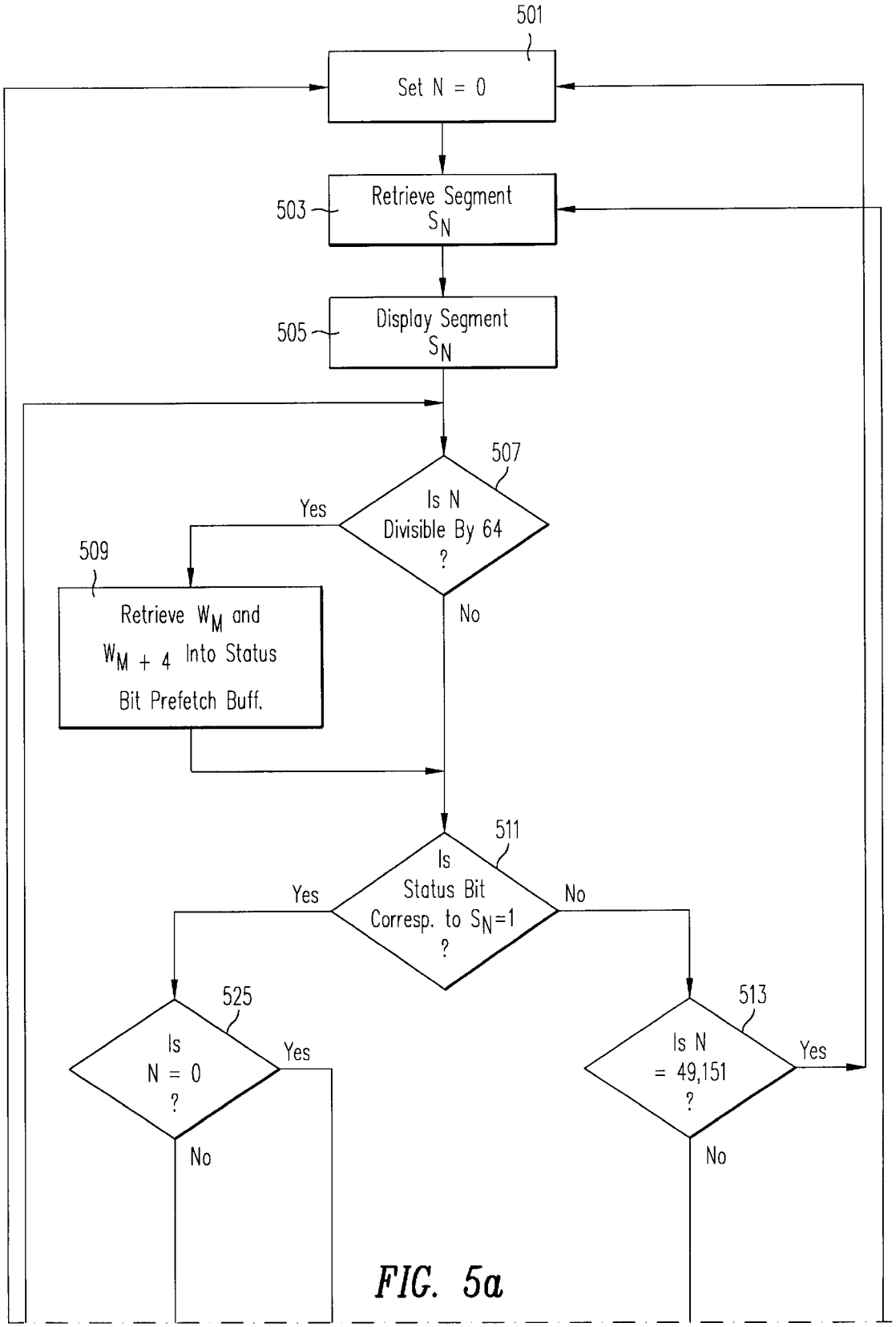
FIG. 5 is a flow diagram which illustrates operation of the memory and display system of FIG. 2 in accordance with one embodiment of the invention.
Figure 5B:
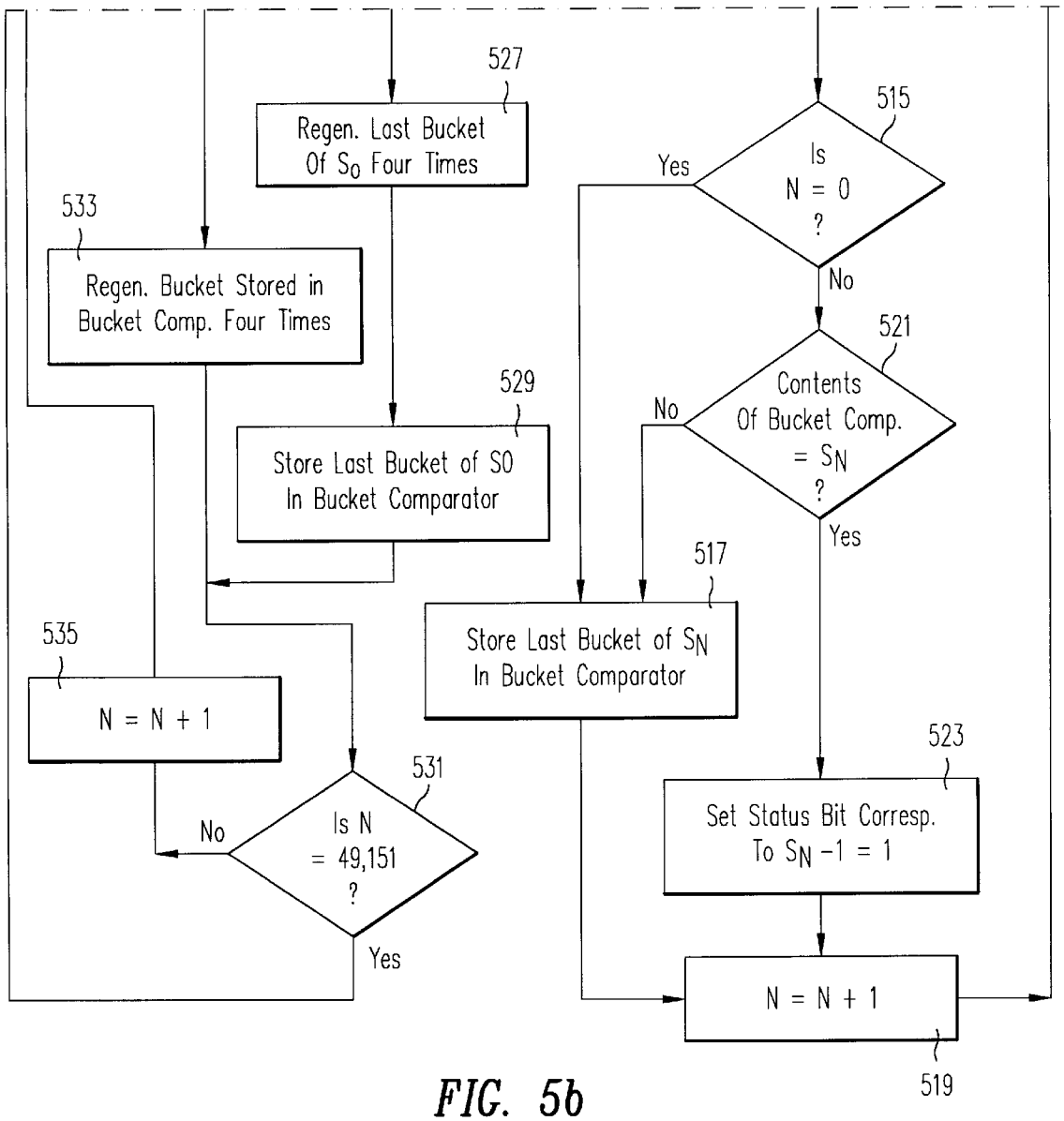
Figure 5:
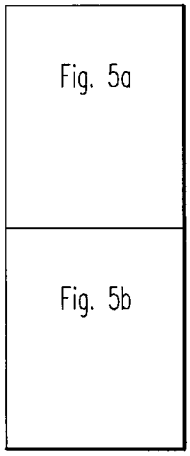

FIG. 5 is a flow diagram illustrating detailed operation of system 200 in accordance with one embodiment of the invention. At the start of a display refresh operation, display controller 206 resets a counter variable N to a "0" value (Step 501). Display controller 206 then instructs memory interface 203 to retrieve segment $S_N$ (e.g., $S_0$) from frame buffer memory 201 (Step 503). Segment $S_0$ is routed through memory interface 203 to display controller 206 on bus 217. Display controller 206 transmits segment $S_N$ (e.g., $S_0$) to DAC 212 and CRT display 213 for display (Step 505).

Display controller 206 also checks counter variable N to determine whether N is divisible by 64 (Step 507). If N is divisible by 64, display controller 206 causes status words $W_M$ and $W_{M+4}$ to be retrieved from status bit memory 202, according to the address mapping shown in FIG. 4 (Step 509). Because each 32-bit status word corresponds to 32 segments (or 1,024 bytes), the overhead of reading status bits is minimal (0.4%). By prefetching the next required status word (i.e., $W_{M+4}$) in Step 509, the latency penalty, which would otherwise be incurred by display controller 206 in performing subsequent operations (such as segment retrieval in Step 503), is eliminated. Status words $W_M$ and $W_{M+4}$ are stored in status bit prefetch buffer 211. For example, when N is equal to "0", status words W0 and W4 are retrieved and stored in status bit prefetch buffer 211. Thus, the status bits corresponding to an entire row of segments (e.g., $S_0$–$S_{63}$) are stored in status bit prefetch buffer 211.

The status bit corresponding to segment $S_N$ (e.g., $S_0$) is then provided to status bit checker 209. Status bit checker 209 determines whether this status bit is set to a "1" value (Step 511). Initially (i.e., before any pixels are displayed), all of the status bits represented by status words $W_0$–$W_{1,535}$ are set to logic "0" values. Thus, during the initial access of each of segments $S_0$–$S_{49,151}$, status bit checker 209 will not detect any status bits having a logic "1" value. As a result, during this initial pass, Step 511 will always produce a "NO" result. Processing therefore continues with Step 513.

In Step 513, display controller 206 determines whether segment $S_N$ represents the last segment S49,151 of the refresh operation. If so, processing returns to Step 501 and the screen refresh operation continues with segment $S_0$. If segment $S_N$ is not the last segment of the refresh operation, display controller 206 determines whether segment $S_N$ represents the first segment $S_0$ of the refresh operation (Step 515). If segment $S_N$ represents the first segment $S_0$, display controller 206 stores the last bucket of segment $S_N$ in bucket comparator 210 (Step 517), increments counter value N by one (Step 519) and returns processing to Step 503, where display controller 206 retrieves the next segment from frame buffer memory 201.

Returning to Step 515, if segment $S_N$ does not represent the first segment $S_0$, the contents of bucket comparator 210 (i.e., the last bucket of previous segment $S_{N-1}$) are compared to each of the buckets of $S_N$ (Step 521). If the last bucket stored in bucket comparator 210 is identical to each of the four buckets of $S_N$, the status bit corresponding to $S_{N-1}$ is set to a logic "1" value (Step 523) and written to status bit memory 202. Counter value N is then incremented (Step 519) and processing continues with Step 503.

For example, during the initial pass, the last bucket of segment $S_0$ is stored in bucket comparator 210. During the subsequent pass, the last bucket of segment $S_0$ is compared to each of the four buckets of segment $S_0$. If the last bucket of segment $S_0$ is identical to each of the four buckets of segment $S_1$, then the status bit corresponding to segment $S_0$ is set to a logic "1" value. During subsequent passes, this status bit will cause segment $S_1$ to be generated by repeating the last bucket of segment $S_0$ four times. This eliminates the need to retrieve segment $S_1$ for subsequent refresh operations, thereby reducing the data bandwidth on bus 217 consumed by the refresh operation.

After each of segments $S_1$–$S_{49,151}$ has been accessed and displayed one time during the initial pass, the status bits stored in status bit memory 202 are representative of the repetitive nature of the pixel values stored in frame buffer memory 201. Processing then returns to Step 501 and proceeds as previously described until reaching Step 511. Because some of the status bits may have been set during the initial pass, it is possible that the status bit corresponding to segment $S_N$ now has a logic "1" value. Status bit checker 209 therefore checks the state of the status bit corresponding to segment $S_N$. If the status bit corresponding to segment $S_N$ has a logic "0" value, processing continues with Step 513 in the manner previously described. However, if the status bit corresponding to segment $S_N$ has a logic "1" value, processing proceeds to Step 525.

In Step 525, display controller 206 determines whether counter variable N has a "0" value. If so, display controller 206 regenerates the last bucket of segment $S_N$ (i.e., the last bucket of segment $S_0$), four times (Step 527). By regenerating the last bucket of segment $S_0$ four times, segment $S_1$ is effectively generated without having to access frame buffer memory 201. The last bucket of segment $S_0$ is then stored in bucket comparator 210 (Step 529).

Counter value N is then monitored by display controller 206 to determine whether $S_N$ represents the last segment $S_{49,151}$ of the screen refresh operation (Step 531). If so, processing returns to Step 501. If not, N is incremented by one (Step 535) and processing returns to Step 507.

Returning to Step 525, if display controller 206 determines that counter variable N does not have a "0" value, the bucket stored in bucket comparator 210 is regenerated four times (Step 533). Processing then proceeds with Step 531 as previously described.

To display a frame of video information in which all of the pixels have the same value (i.e., a solid screen) or in which four pixel values are constantly repeated, only a single access to frame buffer memory 201 is required. In such situations, the status bits corresponding to respective segments $S_0$–$S_{49,150}$ are set to "1" values after the initial pass. The initial segment $S_0$ is then retrieved from frame buffer memory 201 and displayed. Display controller then regenerates the last bucket of segment $S_0$ to create segments $S_1$–$S_{149,151}$.

Each of segments $S_0$–$S_{49,151}$ preferably includes a number of bytes which is equal to the number of bytes received by display controller 206 during an access of frame buffer memory 201 during a screen refresh operation. As a result, a set status bit causes display controller 206 to skip one access to frame buffer memory 201.

Memory interface 203 is responsible for resetting status bits stored in status bits memory 202. Memory interface 203 monitors the write accesses to frame buffer memory 201 from all processors or processes coupled to system bus 217. For any detected write access, memory interface 203 determines the segment to which the write access is directed and resets the status bit of this segment, regardless of whether the write access actually modifies data stored in frame buffer memory 201. A group of four consecutive status words from status words $W_0$–$W_{1,535}$ are cached in status bit cache memory 205. Because most write accesses exhibit both horizontal and vertical locality, the four status words cached in status bit cache memory 205 include four vertically consecutive status words as arranged in FIG. 4. Thus, thirty two horizontally consecutive segments in each of four consecutive rows of display 213 can be modified with a single access to status bit memory 202.

The content of status bit cache memory 205 is written back to status bit memory when a write access to a segment not represented by the contents of status bit cache memory 205 (cache-miss) is detected. Subsequently, the new group of four status words is loaded into status bit cache memory 205. This new group of four status words includes the status word which corresponds to the segment involved int the write access. For example, if status words $W_0$–$W_3$ are stored in status bit cache memory 205 and memory write checker 204 detects a write access to a segment which corresponds to status word $W_{13}$, status words $W_0$–$W_3$ are written back to status bit memory 202 and status words $W_{12}$–$W_{15}$ are retrieved from status bit memory 202 and stored in status bit cache memory 205.

In another embodiment of the invention, the sizes of the segments and buckets are changed dynamically by display controller 206. In another embodiment, display controller 206 dynamically enables and disables the previously described operation of system 200. In such embodiments, display controller 206 implements a status bit counter which monitors the performance of system 200 by counting the frequency at which the status bits are being set. In response to this status bit counter, display controller 206 appropriately adjusts system 200 to achieve optimum performance.

Although the invention has been described in connection with several embodiments, it is understood that this invention is not limited to the embodiments disclosed, but is capable of various modifications which would be apparent to one of ordinary skill in the art. Thus, the invention is limited only by the following claims.

What is claimed is:

1. A signal processing system comprising:

a bus;

a frame buffer memory coupled to the bus, wherein the frame buffer memory has capacity to store uncompressed pixel data for a frame of video information;

a display controller coupled to the bus, wherein the display controller can access pixel data from the frame buffer memory over the bus; and a status bit memory coupled to the display controller, wherein the status bit memory stores a plurality of status bits representative of repetitive characteristics of pixel data stored in the frame buffer;

wherein the frame buffer memory is divided into a plurality of consecutive segments, and each segment is further divided into a plurality of fixed length sub-units; with each sub-unit representing a plurality of pixel values, and wherein each of the status bits stored in the status bit memory corresponds only to one of the segments and indicates whether one of the sub-units of the corresponding segment is identical to each of the sub-units in a next consecutive segment.

2. The system of claim 1, wherein the display controller comprises a sub-unit comparator which compares one sub-unit of a segment with each of the sub-units of a consecutive segment.

3. The system of claim 1, wherein the display controller comprises:

a status bit checker which monitors the status bits corresponding to each segment; and means for regenerating a sub-unit of a segment when a status bit indicates that the sub-unit of the segment is identical to each of the sub-units in a consecutive segment, whereby the display controller is not required to access the frame buffer memory to provide the consecutive segment.

4. The system of claim 1, further comprising a prefetch buffer for prefetching a plurality of status bits, the prefetch buffer coupled between the status bit memory and the display controller.

5. The system of claim 1, further comprising a memory interface coupled between the bus and the frame buffer memory, wherein the memory interface has a memory write checker which monitors write accesses to the frame buffer memory, determines the segments to which the write accesses are directed and resets the status bits corresponding to the segments to which the write accesses are directed.

6. The system of claim 5, further comprising a status bit cache memory coupled between the status bit memory and the memory interface, wherein the status bit cache memory stores a plurality of the status bits.

7. The system of claim 1, wherein the status bit memory and the frame buffer memory are located in the same memory device.

8. The system of claim 1, wherein the status bit memory and the frame buffer memory are separate memory devices.

9. A method for performing a screen refresh operation in a video processing system having a frame buffer memory which stores a frame of pixel data, the method comprising:

partitioning the pixel data in the frame buffer memory into a plurality of consecutive segments;

partitioning each of the segments into a plurality of fixed length sub-units, wherein each sub-unit represents an integer number of pixels;

retrieving a first segment from the frame buffer memory;

storing a sub-unit of the first segment in a sub-unit memory external to the frame buffer memory;

retrieving a second segment which is next consecutive with the first segment from the frame buffer memory;

comparing the sub-unit of the first segment stored in the sub-unit memory with each sub-unit of the second segment; and setting a status bit corresponding only to the first segment if the sub-unit of the first segment stored in the sub-unit memory is identical to each sub-unit of the second segment.

10. The method of claim 9, further comprising the following steps, which are performed after the steps of comparing and setting have been performed at least once:

determining whether the status bit corresponding to the first segment is set; and regenerating a sub-unit stored in the sub-unit memory to create the second segment, whereby the second segment is not required to be retrieved from the frame buffer memory if the status bit is set.

11. The method of claim 10, wherein the sub-unit stored in the sub-unit memory is a sub-unit of the first segment.

12. The method of claim 9, wherein the sub-unit of the first segment stored in the sub-unit memory is the last sub-unit of the first segment.

13. The method of claim 9, further comprising the step of prefetching a plurality of status bits corresponding to a plurality of segments.

14. The method of claim 9, further comprising the step of resetting the status bit corresponding to the first segment when a write operation is performed to the first segment in the frame buffer memory.

15. The method of claim 14, further comprising the step of caching a plurality of status bits corresponding to a plurality of segments.

16. The system of claim 1, wherein there is only a single status bit stored in the status bit memory for each of the segments.

17. The method of claim 9, further comprising setting only a single status bit for each of the segments.

* * * * *